US005700984A

United States Patent [19]

Tsai

[11] Patent Number: 5,700,984

[45] Date of Patent: Dec. 23, 1997

[54] METHOD OF FABRICATING KEY SWITCHES AND THE PRODUCT THEREOF

[75] Inventor: Chi-Lung Tsai, Taipei Hsien, Taiwan

[73] Assignee: Silitek Corporation, Taipei, Taiwan

[21] Appl. No.: 651,497

[22] Filed: May 22, 1996

[51] Int. Cl.[6] ..... H01H 9/00

[52] U.S. Cl. ..... 200/5 A; 200/310

[58] Field of Search ..... 200/5 A, 159 B, 200/310, 511, 517, 512, 513, 308, 309, 312; 29/622, 210

[56] References Cited

U.S. PATENT DOCUMENTS 4,302,648 11/1981 Sado et al. ..... 200/159 B 5,270,507 12/1993 Nakamura et al. ..... 200/511

*Primary Examiner*—Peter S. Wong

*Assistant Examiner*—Rajnikant B. Patel

*Attorney, Agent, or Firm*—Beveridge, DeGrandi, Weilacher & Young, LLP

[57] ABSTRACT

A key switch fabrication method including the steps of: i) molding a rubber pad from silicone resin, and making a rubber key stitch body from the rubber pad by stamping; ii) printing the desired letter or pattern on the top side (10) of the rubber key switch body (1) thus obtained, then drying the printed key switch body 1 by baking; iii) adhering a liquid silicone rubber on the key switch body over the printing thereof by spot glueing to form a transparent key cap; vi) heating the key switch thus obtained from step iii) in a baking oven at 60° C. for 5 minutes and then heating it at 120° C. for 10 minutes to harden the key cap; and v) examining the quality of the finished key pad.

6 Claims, 2 Drawing Sheets

METHOD OF FABRICATING KEY SWITCHES AND THE PRODUCT THEREOF

BACKGROUND OF THE INVENTION

The present invention relates to a method of fabricating a key switch having a dome-like, transparent rubber key cap On the rubber key switch body thereof. The present invention relates also to a key switch made according to this method.

Regular electric apparatus, for example, mobile telephones, remote controllers, calculators, etc., are commonly equipped with a set of key switches for operation. The method of fabricating these key switches includes the step of molding a key switch body from rubber, the step of coating a media on the rubber key switch body, the step of molding a dome-like, transparent plastic key cap on the media. The dome-like, transparent plastic key cap protects the rubber key switch body and serves as a lens to magnify the letter or pattern on the top side of the key switch body. This manufacturing process is complicated, therefore the manufacturing cost of the key switch is high. Furthermore, the quality of the key switch is difficult to be controlled.

SUMMARY OF THE INVENTION

The present invention has been accomplished to provide a key switch fabrication method which eliminates the aforesaid drawbacks. It is one object of the present invention to provide a key switch fabrication method which simplifies the manufacturing flow of the key switch. It is another object of the present invention to provide a key switch fabrication method which achieves a constant quality. It is still another object of the present invention to provide a key switch fabrication method which greatly reduces the manufacturing cost of the key switch. It is still another object of the present invention to provide a key switch which is durable in use. It is still another object of the present invention to provide a key switch which magnifies the printing thereof. According to the present invention, the method included the steps of: i) molding a rubber pad from silicone resin, and making a rubber key switch body from the rubber pad by stamping; ii) printing the desired letter or pattern on the top side (10) of the rubber key switch body (1) thus obtained, then drying the printed key switch body 1 by baking; iii) adhering a liquid silicone rubber on the key switch body over the printing thereof by spot glueing to form a transparent key cap; vi) heating the key switch thus obtained from step iii) in a baking oven at 60° C. for 5 minutes and then heating it at 120° C. for 10 minutes to harden the key cap; and v) examining the quality of the finished key pad.

DETAILED DESCRIPTION OF THE PREFERRED EMBODIMENT

Figure 1:
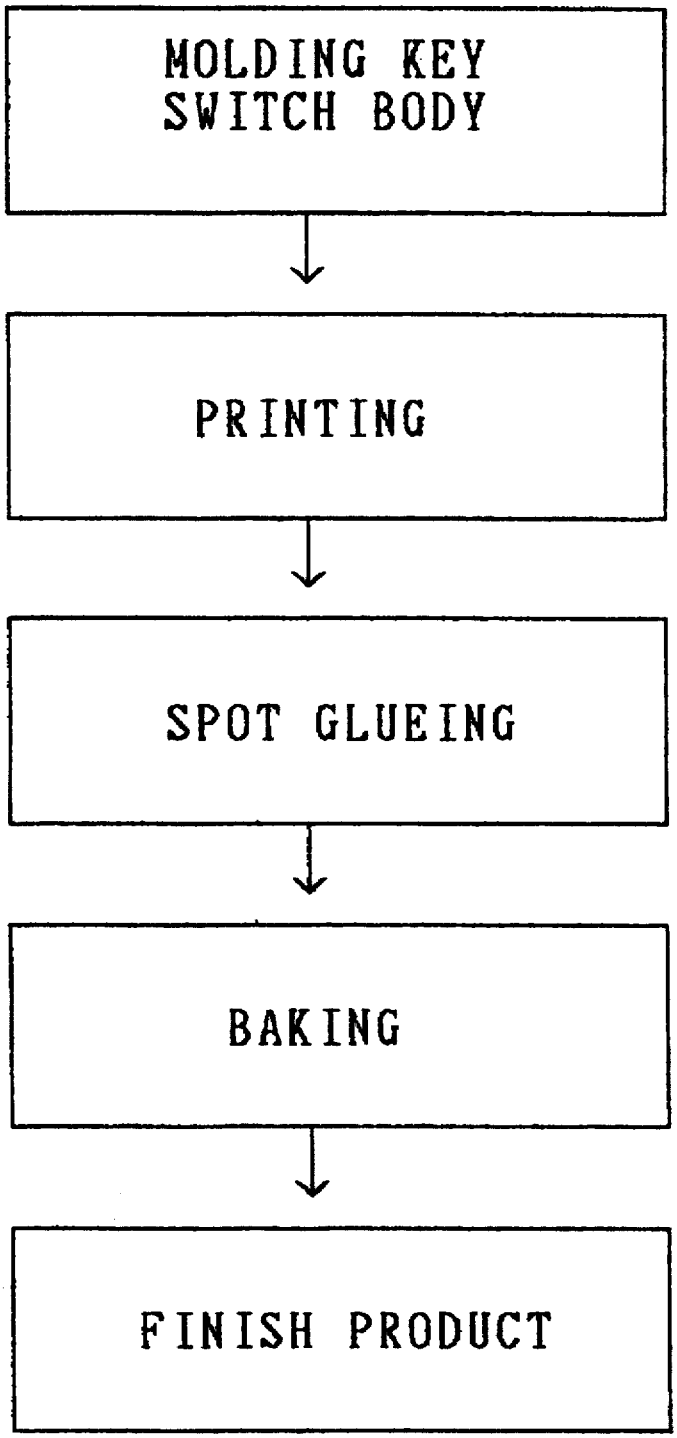
FIG. 1 is a block diagram showing the production flow of the present invention.
Figure 2:
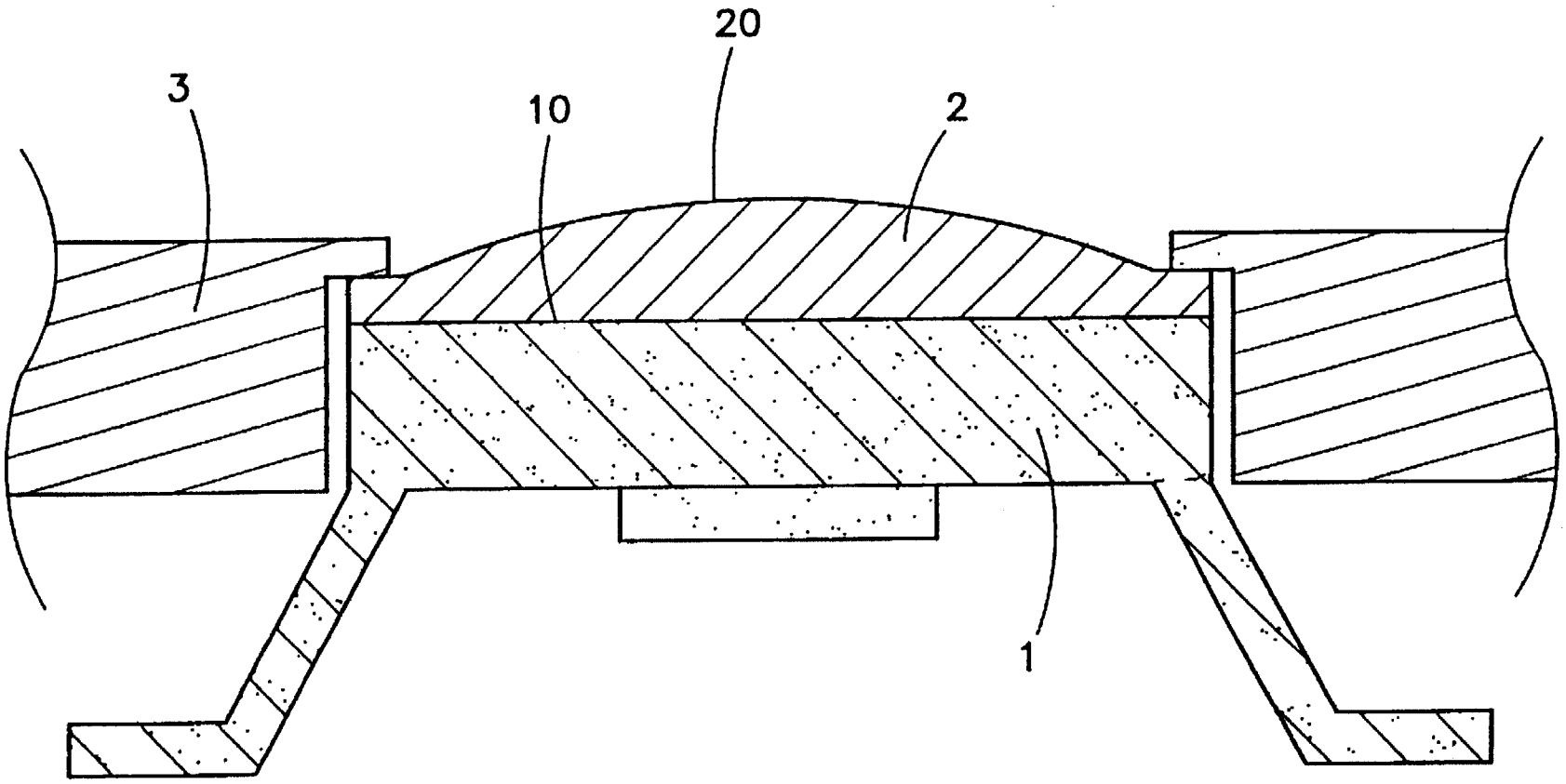
FIG. 2 is a plain view of a key switch made according to the present invention and installed in the frame of an electric apparatus.

Referring to FIGS. 1 and 2, the method of the present invention comprises the steps of: i) preparing a silicone rubber pad from high temperature vulcanization silicone rubber, then making a rubber key switch body (1) from the silicone rubber pad by stamping; ii) printing the desired letter or pattern on the top side (10) of the rubber key switch body (1) thus obtained, then drying the printed key switch body 1 by baking; iii) adhering a room temperature vulcanization silicone rubber or a liquid silicone rubber to the top side (10) of the rubber key switch body (1) by spot glueing to form a transparent key cap (2) having a convex top side (20); vi) heating the key switch thus obtained from step iii) in a baking oven at 60° C. for 5 minutes and then heating it at 120° C. for 10 minutes to harden the key cap (2) to the degree of hardness about JIS 50°–90°; and v) examining the quality of the finished key pad. Because the material for the key switch body (1) and the material for the key cap (2) have the same chain structure Si—O—Si—O—Si, they provide the same surface tension. Therefore, the liquid silicone rubber does not overflow when adhered to the key switch body.

According to an alternate form of the present invention, the method comprises the steps of: i) preparing a silicone rubber pad from high temperature vulcanization silicone rubber, then making a rubber key switch body from the silicone rubber pad by stamping; ii) printing the desired letter or pattern on the rubber key switch body thus obtained and then drying the printed key switch body by baking; iii) molding a transparent key cap (2) from a transparent silicone resin on the top side (10) of the rubber key switch body (1) to form a transparent key cap (2) having a convex top side (20); vi) drying the key switch thus obtained from step iii) at room temperature; v) examining the quality of the finished key pad.

FIG. 2 shows the key switch installed in the frame (3) of an electric apparatus. As illustrated, the key switch comprises a rubber key switch body (1), and a transparent rubber key cap (20) covered on the top side (10) of the rubber key switch body (1) and having a convex top side (20). The transparent rubber key cap (20) acts as a convex lens which magnifies the letter (pattern) at the top side (10) of the key switch body (1).

It is to be understood that the drawings are designed for purposes of illustration only, and are not intended as a definition of the limits and scope of the invention disclosed.

I claim:

1. A key switch fabrication method including the steps of:

i) molding a rubber pad from silicone resin, and making a rubber key switch body from the rubber pad by stamping;

ii) printing the desired letter or pattern on the top side (10) of the rubber key switch body (1) thus obtained, then drying the printed key switch body 1 by baking;

iii) adhering a liquid silicone rubber on the key switch body over the printing thereof by spot glueing to form a transparent key cap;

vi) heating the key switch thus obtained from step iii) in a baking oven at 60° C. for 5 minutes and then heating it at 120° C. for 10 minutes to harden the key cap; and v) examining the quality of the finished key pad.

2. The key switch fabrication method of claim 1 wherein said transparent cap has a convex top side serving as a convex lens to magnify the printing of said key switch body.

3. A key switch fabrication method including the steps of:

i) molding a rubber pad from silicone resin, and making a rubber key switch body from the rubber pad by stamping;

ii) printing the desired letter or pattern on the top side (10) of the rubber key switch body (1) thus obtained, then drying the printed key switch body 1 by baking;

iii) molding a transparent key cap from a transparent silicone resin on the rubber key switch body over the printing;

vi) drying the key switch thus obtained from step iii) at room temperature; and v) examining the quality of the finished key pad.

4. The key switch fabrication method of claim 1 wherein said transparent cap has a convex top side serving as a convex lens to magnify the printing of said key switch body.

5. A key switch made according to claim 1, comprising a rubber key switch body having a printed top side, and a transparent rubber key cap covered on said rubber key switch body over the printed top side thereof and having a convex top side which magnifies the printing of the printed top side of said rubber key switch body, said key switch body and said key cap being made from silicone resins having the same chain structure.

6. A key switch made according to claim 3, comprising a rubber key switch body having a printed top side, and a transparent rubber key cap covered on said rubber key switch body over the printed top side thereof and having a convex top side which magnifies the printing of the printed top side of said rubber key switch body, said key switch body and said key cap being made from silicone resins having the same chain structure.

* * * * *